US012485308B2

(12) United States Patent
Scherff

(10) Patent No.: US 12,485,308 B2
(45) Date of Patent: Dec. 2, 2025

(54) COMBINED TREATMENT AND EXERCISE APPARATUS

(71) Applicant: Law Office of Jerry Joseph, PLC, Washington, DC (US)

(72) Inventor: Brian Scherff, Paw Paw, MI (US)

( * ) Notice: Subject to any disclaimer, the term of this patent is extended or adjusted under 35 U.S.C. 154(b) by 129 days.

(21) Appl. No.: 18/211,443

(22) Filed: Jun. 19, 2023

(65) Prior Publication Data

US 2023/0329947 A1 Oct. 19, 2023

Related U.S. Application Data

(63) Continuation of application No. 16/817,071, filed on Mar. 12, 2020, now Pat. No. 11,717,458.

(60) Provisional application No. 62/817,892, filed on Mar. 13, 2019.

(51) Int. Cl.

| | |
|---|---|
| ***A63B 22/00*** | (2006.01) |
| ***A63B 22/16*** | (2006.01) |
| ***A63B 22/18*** | (2006.01) |
| ***A63B 23/04*** | (2006.01) |

(52) U.S. Cl.

CPC ..... *A63B 22/0048* (2013.01); *A63B 22/0056* (2013.01); *A63B 22/16* (2013.01); *A63B 22/18* (2013.01); *A63B 23/04* (2013.01); *A63B 2208/0242* (2013.01); *A63B 2208/0252* (2013.01); *A63B 2208/0257* (2013.01)

(58) Field of Classification Search

CPC . A63B 22/0048; A63B 22/0056; A63B 22/16; A63B 22/18; A63B 23/04; A63B 2208/0242; A63B 2208/0252; A63B 2208/0257

See application file for complete search history.

(56) References Cited

U.S. PATENT DOCUMENTS

| | | | | |
|---|---|---|---|---|
| 7,871,358 | B2 * | 1/2011 | Graham | A63B 23/0405 482/142 |
| 8,249,714 | B1 * | 8/2012 | Hartman | A63B 23/03525 607/48 |
| 9,132,051 | B2 * | 9/2015 | Heil | A61G 7/012 |
| 11,446,191 | B2 * | 9/2022 | Zerhusen | A63B 21/068 |
| 2006/0293156 | A1 * | 12/2006 | Trees | A63B 21/0622 482/148 |
| 2015/0196442 | A1 * | 7/2015 | Heil | A61G 7/012 5/613 |

* cited by examiner

*Primary Examiner* — Zachary T Moore

(74) *Attorney, Agent, or Firm* — Law Office of Jerry Joseph, PLC; Jerry Joseph

(57) ABSTRACT

A combined treatment, exercise, and traction apparatus including a base, a support frame supported by the base and having a first end and an opposing second end, a treatment table mounted to the support frame and a first foot rest member frame and a second foot rest member frame, wherein the first foot rest member frame includes a first foot rest member, and wherein the second foot rest member frame includes a second foot rest member, wherein each foot rest member frame is pivotally coupled to the second end of the support frame, and wherein each of the first and second foot rest member frames are independently pivotable relative to the support frame between a first foot rest member frame position generally parallel to the support frame and a second foot rest member frame position generally perpendicular to the support frame.

18 Claims, 14 Drawing Sheets

COMBINED TREATMENT AND EXERCISE APPARATUS

BACKGROUND OF THE INVENTION

1. Field of the Invention

The present general inventive concept relates to a physical therapy and exercise table, and more particularly, to a combined treatment, traction and exercise table designed to strengthen lower extremities of a patient.

2. Description of Related Art

There have been previous devices, known as tilt tables, have been developed that can be used to gradually tilt a patient from a horizontal position to a vertical position. However, these tilt tables are only able to lift the patient to an upright position while simultaneously restricting the movement of the patient's lower extremities. These conventional tilt tables are often large and bulky and are designed for hospital settings.

Therefore, what is desired is a portable therapy apparatus that combines a treatment table, an exercise device, and a traction table into a single, light-weight and portable device designed to strengthen lower extremities of a user while reducing a risk of injury.

SUMMARY OF THE INVENTION

A combined treatment and exercise apparatus according to the present general inventive concept provides a multiple function exercise machine that may also be used as a treatment table. In particular, the combined treatment and exercise apparatus combines a plurality of functions, including a full electric treatment and manipulation table, a lower extremity exercise machine, a versatile traction table, an apparatus configured to allow for open chain arm exercises with a pulley system, and a tilt or inversion table into a single integrated device.

Certain of the foregoing and related aspects and/or features are readily attained according to the present general inventive concept by providing a combined treatment, exercise, and traction apparatus which includes a base coupled to a plurality of linkages, a support frame having a first end and opposing second end and pivotally coupled to the plurality of linkages, the support frame formed to pivot between a first orientation and a different second orientation, a treatment table having a first end and an opposing second end, the treatment table slidably mounted to the support frame and a plurality of actuators coupled between the base and the plurality of linkages, wherein the treatment table slides between a first position and a second position along a plane of the support frame when a first actuator is activated.

The combined treatment, exercise, and traction apparatus may further include a second actuator formed to selectably pivot the support frame between the first orientation and the second orientation when a second actuator is activated.

An angle between the first orientation and the second orientation may be about 100 degrees.

The treatment table at the second position may be further away from the first end of the support frame than when the treatment table is at the first position.

The treatment table may move about 1 to about 50 inches between the second position and the first position.

The combined treatment, exercise, and traction apparatus may further include a first footrest member and a second foot rest member pivotably coupled to the first end of the support frame.

The first footrest member may pivot independently from the second foot rest member.

The first foot rest member and the second foot rest member may each pivot independently about 100 degrees.

The first foot rest member and the second foot rest member may each be selectably lockable at varying degrees.

The combined treatment, exercise, and traction apparatus may further include a traction unit coupled to the second end of the support frame formed to apply traction to a user.

The treatment table may have a width of between about 20 inches and about 50 inches.

The treatment table may have a length of between about 48 inches and about 100 inches.

The combined treatment, exercise, and traction apparatus may further include a locking member to selectably lock the treatment table in various positions between the first position and the second position.

The combined treatment, exercise, and traction apparatus may further include removable hand rails disposed on opposite sides of the treatment table to provide support for a user.

The removable hand rails may be formed with a width of about 6 inches to about 36 inches.

The combined treatment, exercise, and traction apparatus may further include a plurality of lockable wheels coupled to the base The combined treatment, exercise, and traction apparatus may further include a lift mechanism formed to lift the treatment table from a first height to a second different height with respect to the base.

The combined treatment, exercise, and traction apparatus may further include a digital scale integrally formed between the treatment table and the support frame and configured to provide a load measurement of the user during treatment and/or exercise.

In alternative embodiments, the digital scale is configured to provide a load measurement of the user, while the treatment table is in a non-horizontal position.

In contrast with conventional treatment tables disclosed by the prior art, the present general inventive concept includes a large-sized treatment table which provides a larger surface area to allow all patients, including bariatric patients to easily transfer on and off the table, without fear of falling. In other words, since the combined treatment, exercise, and traction apparatus according to the present general inventive concept is designed and/or configured to easily transition from a full electric treatment table to an exercise apparatus, the risk of injury to the patient is significantly reduced. That is, a patient using the combined treatment, exercise, and traction apparatus can transition from receiving treatment to receiving traction to performing a variety of lower extremity exercises, without having to use different tables. As such, the patient experiences less anxiety and fear and resulting in better compliance and improved recovery time as compared to conventional treatment tables.

BRIEF DESCRIPTIONS OF THE DRAWINGS

These and/or other aspects of the present general inventive concept will become apparent and more readily appreciated from the following description of the embodiments, taken in conjunction with the accompanying drawings of which:

DESCRIPTION OF INVENTION

Figure 1:
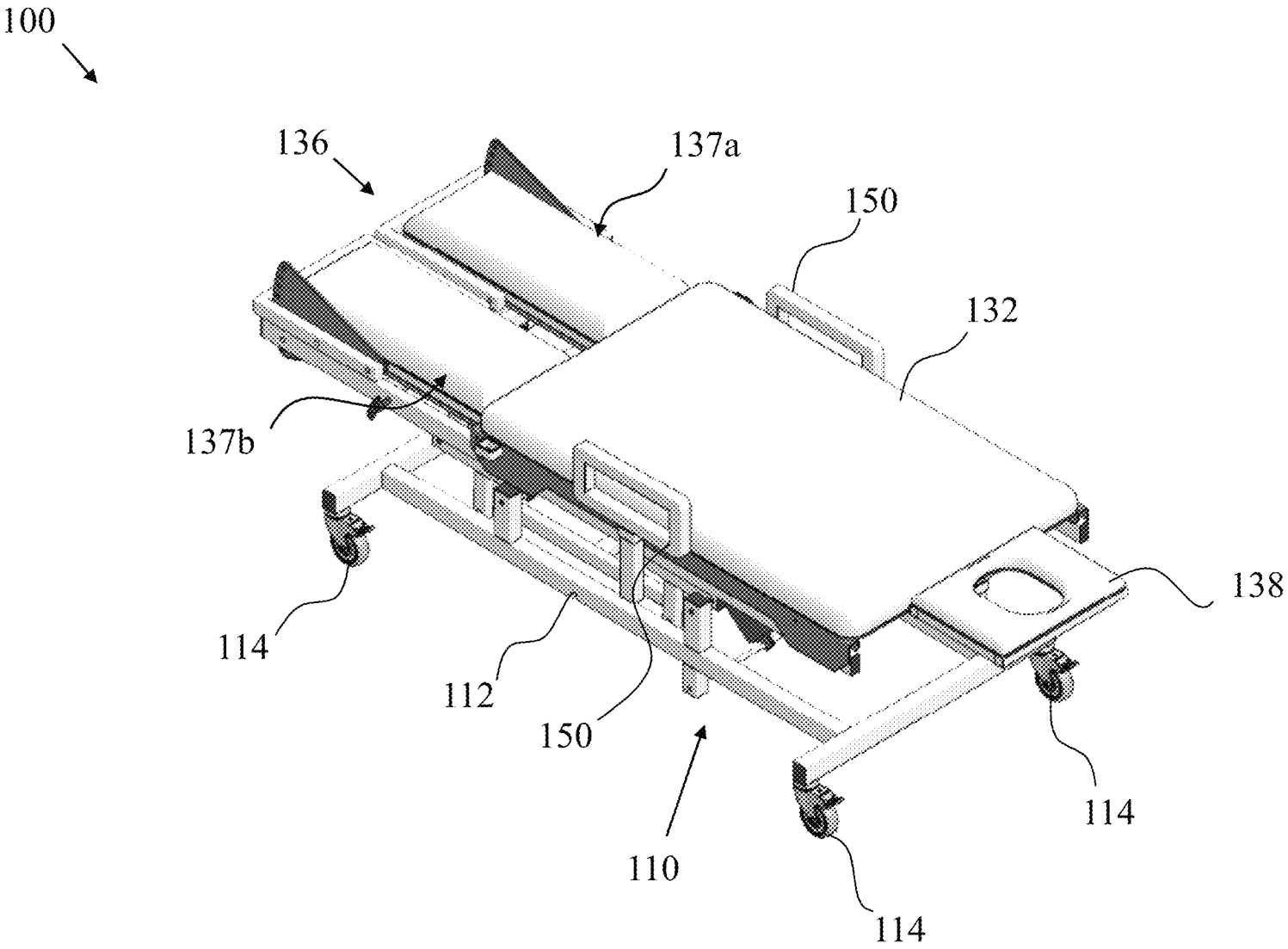
FIG. 1 is a front perspective view a combined treatment and exercise apparatus according to an embodiment of the present inventive concept.

Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

Figure 2A:
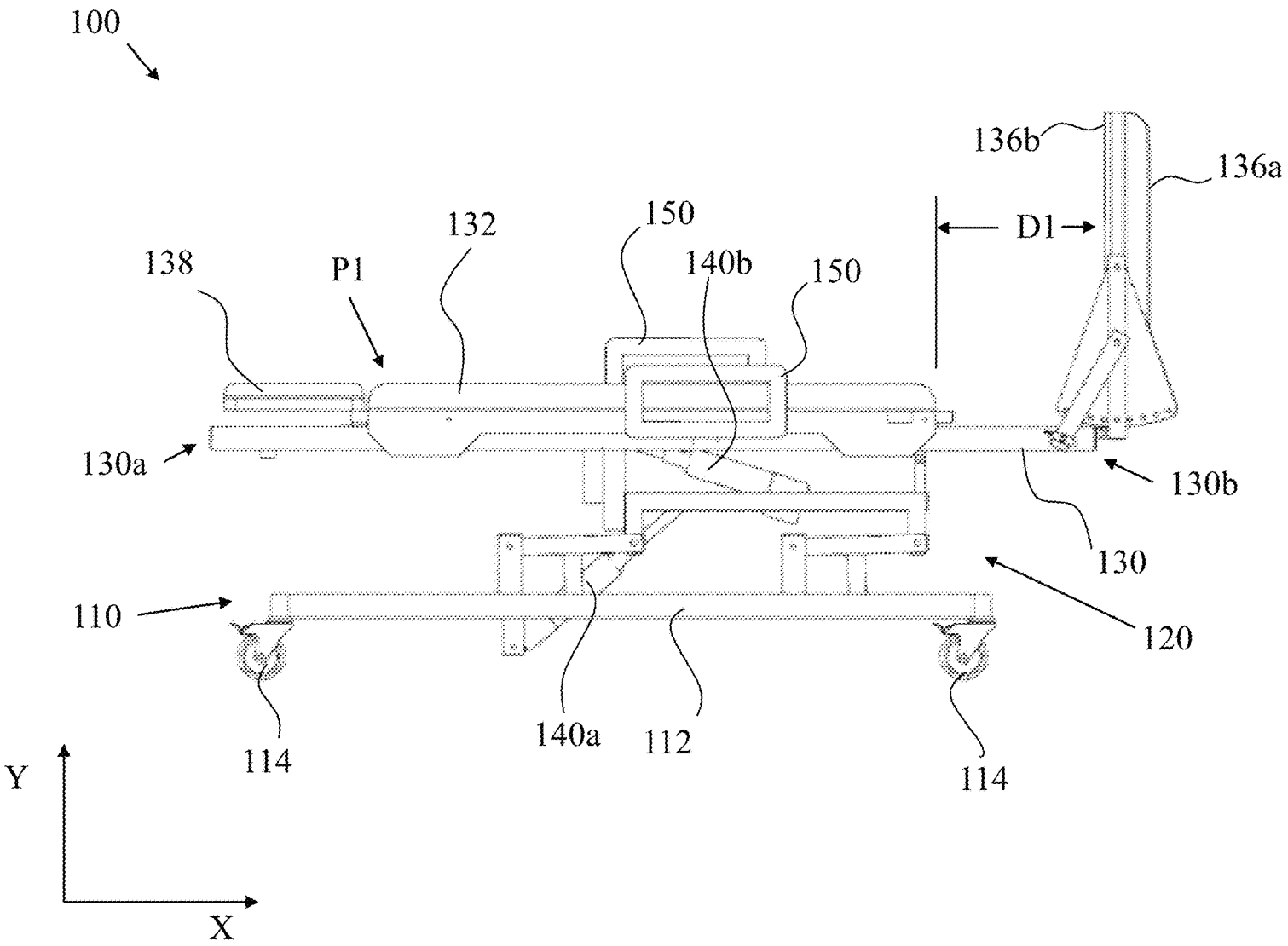
FIG. 2A illustrates a side view of the combined treatment and exercise apparatus illustrated in FIG. 1, wherein the treatment table is in a first position.
Figure 2B:
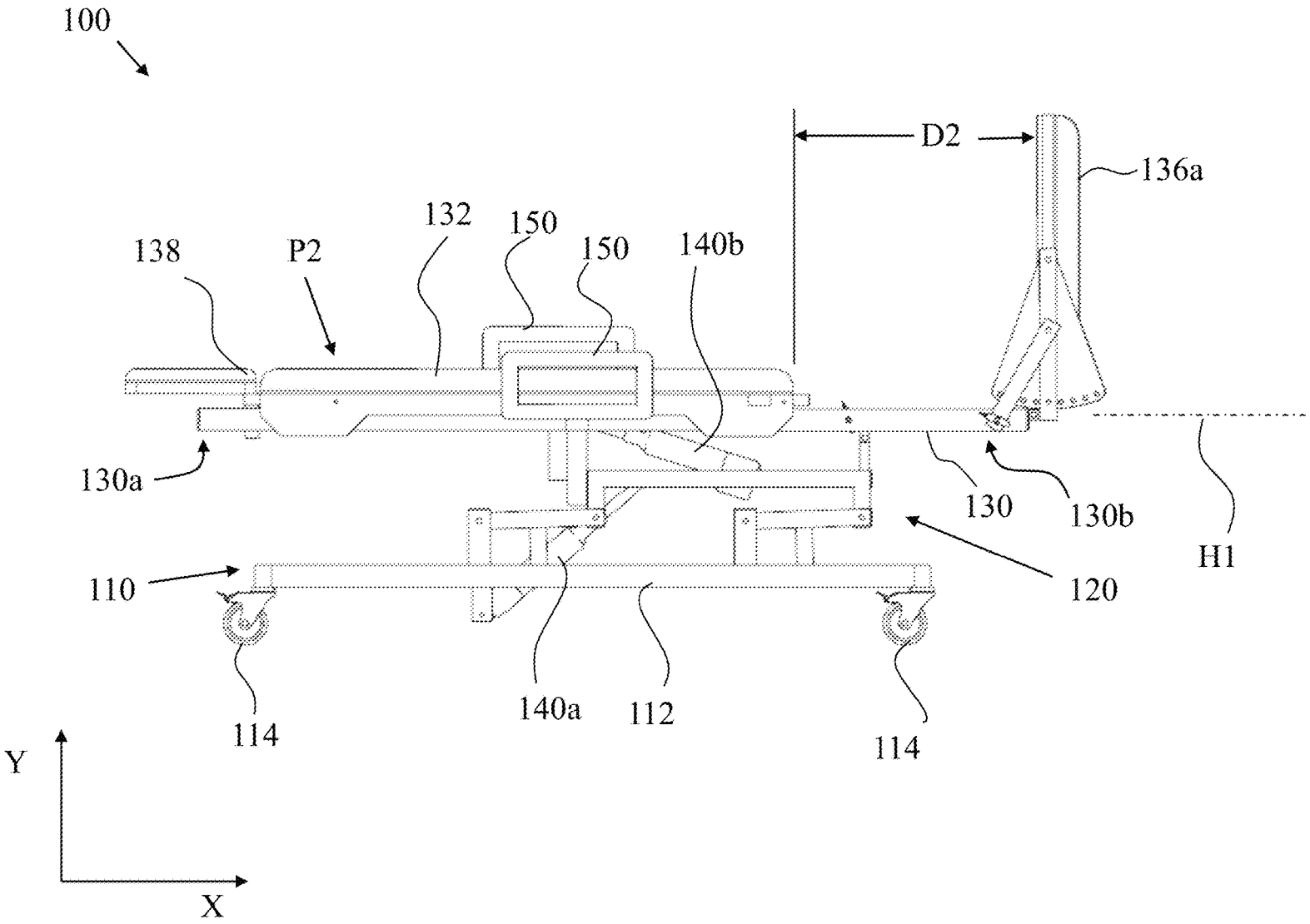
FIG. 2B illustrates a side view of the combined treatment and exercise apparatus illustrated in FIG. 1, wherein the treatment table is in a second position.
Figure 3:
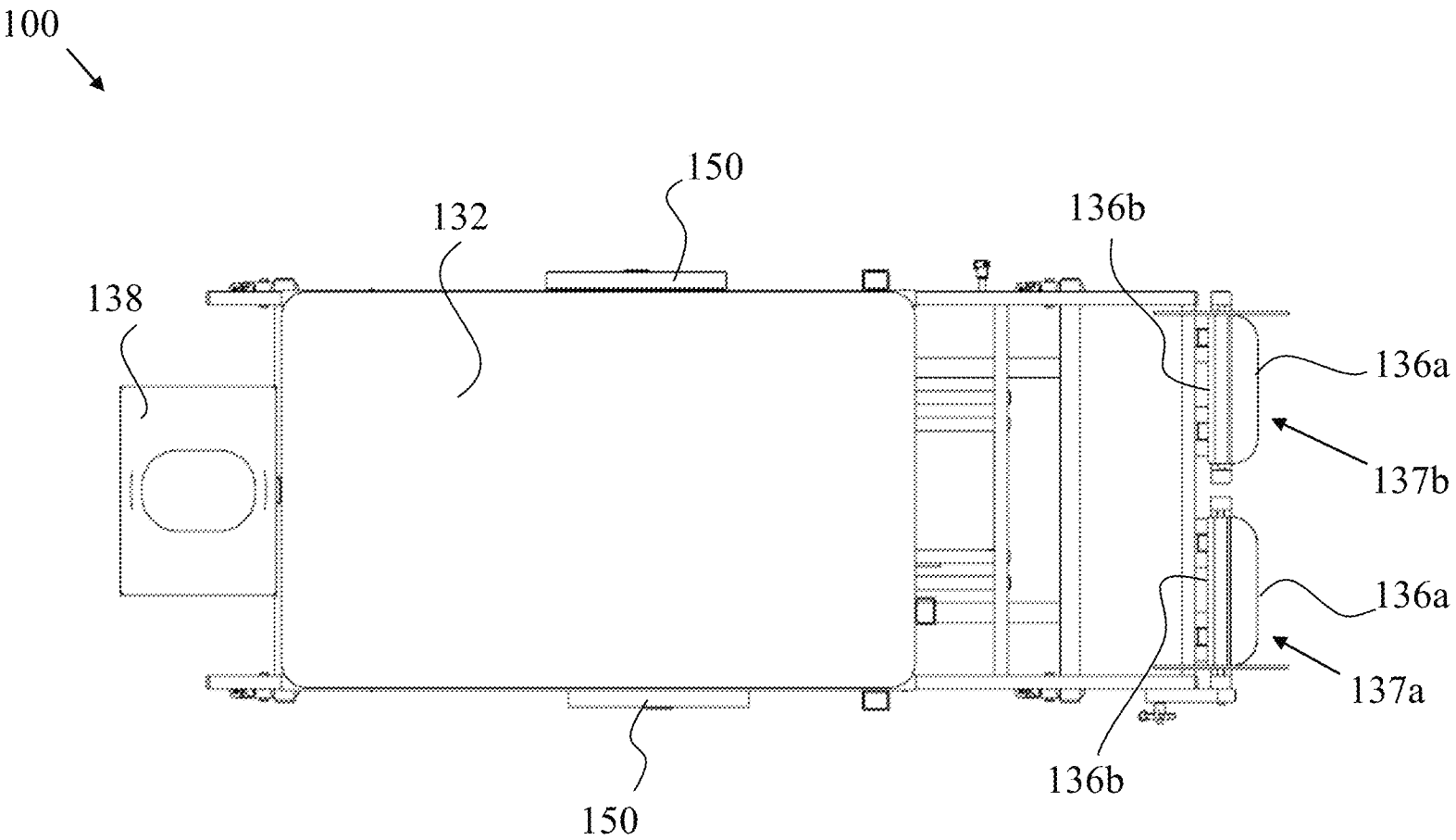
FIG. 3 is a top view of the combined treatment and exercise apparatus illustrated in FIG. 1.

FIG. 1 is a front perspective view a combined treatment and exercise apparatus 100 according to an embodiment of the present inventive concept, FIG. 2A illustrates a side view of the combined treatment and exercise apparatus 100 illustrated in FIG. 1, wherein the treatment table is in a first position, and FIG. 2B illustrates a side view of the combined treatment and exercise apparatus 100 illustrated in FIG. 1, wherein the treatment table is in a second position. FIG. 3 is a top view of the combined treatment and exercise apparatus 100 illustrated in FIG. 1.

Referring to FIGS. 1 through 3, the combined treatment and exercise apparatus, designated generally as 100, is illustrated. In the present embodiment, the combined treatment and exercise apparatus 100 is designed and configured as a portable therapy apparatus that combines a treatment table, an exercise device, and a traction table into a single, light-weight and portable device. That is, the combined treatment and exercise apparatus 100 is designed as a portable combined treatment, exercise, and traction device designed to easily transition a patient (i.e., a user) from the treatment table to an exercise apparatus capable of being used to perform lower extremity exercises on the patient, without the patient needing to get off the treatment table 132. However, the present general inventive concept is not limited thereto.

In the present embodiment, the combined treatment and exercise apparatus 100 includes a base 110 coupled to a plurality of linkages 120, a support frame 130 having a first end 130*a* and an opposing second end 130*b*, a treatment table 132 slidably mounted to the support frame 130, and a plurality of actuators 140*a*, 140*b* configured to move (e.g., slide) the treatment table 132 between a first position P1 to a different second position P2. However, the present general inventive concept is not limited thereto. The base 110 may include a base frame 112 to which the plurality of linkages 120 and one or more of the actuators 140*a* may be attached.

In other words, the treatment table 132 may be moved using one or more actuators 140*a*, 140*b* from the first position P1 at a first distance D1 from the foot rest member 136 to the second position P2 at a second distance D2 from the foot rest member 136.

In the present embodiment, the treatment table 132 at the second position P2 is further away (e.g., D2) from the second end 130*b* of the support frame 130 than the treatment table 132 at the first position P1 (e.g., D1). For instance, the treatment table 132 moves about 28 inches between the second position P2 and the first position P1. The support frame 130 may be manufactured from various rigid materials including, but not limited to, steel. The support frame 130 may further include a plurality of ball bearings to allow the treatment table 132 to easily slide between the first and second positions P1, P2.

That is, in exemplary embodiments, from an initial position P1, the treatment table 132 slides about from about 1 inch to about 40 inches toward the opposing second end 130*b* of the support frame 130 and from about 1 inch to about 20 inches toward the first end 130*a* of the support frame 130.

Figure 4A:
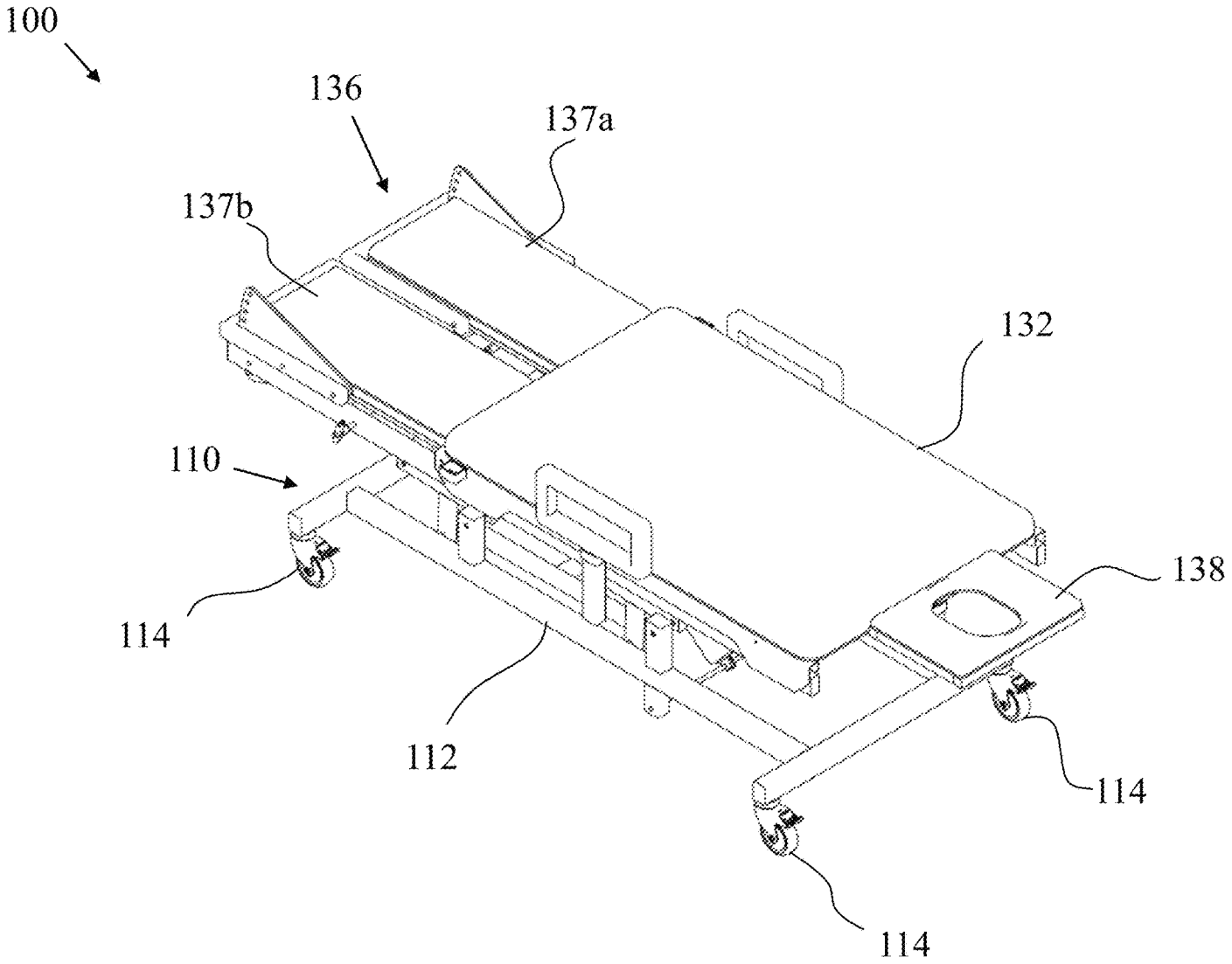
FIG. 4A is a right-side perspective view of the combined treatment and exercise apparatus illustrated in FIG. 1, having the foot rest members in a first state.
Figure 4B:
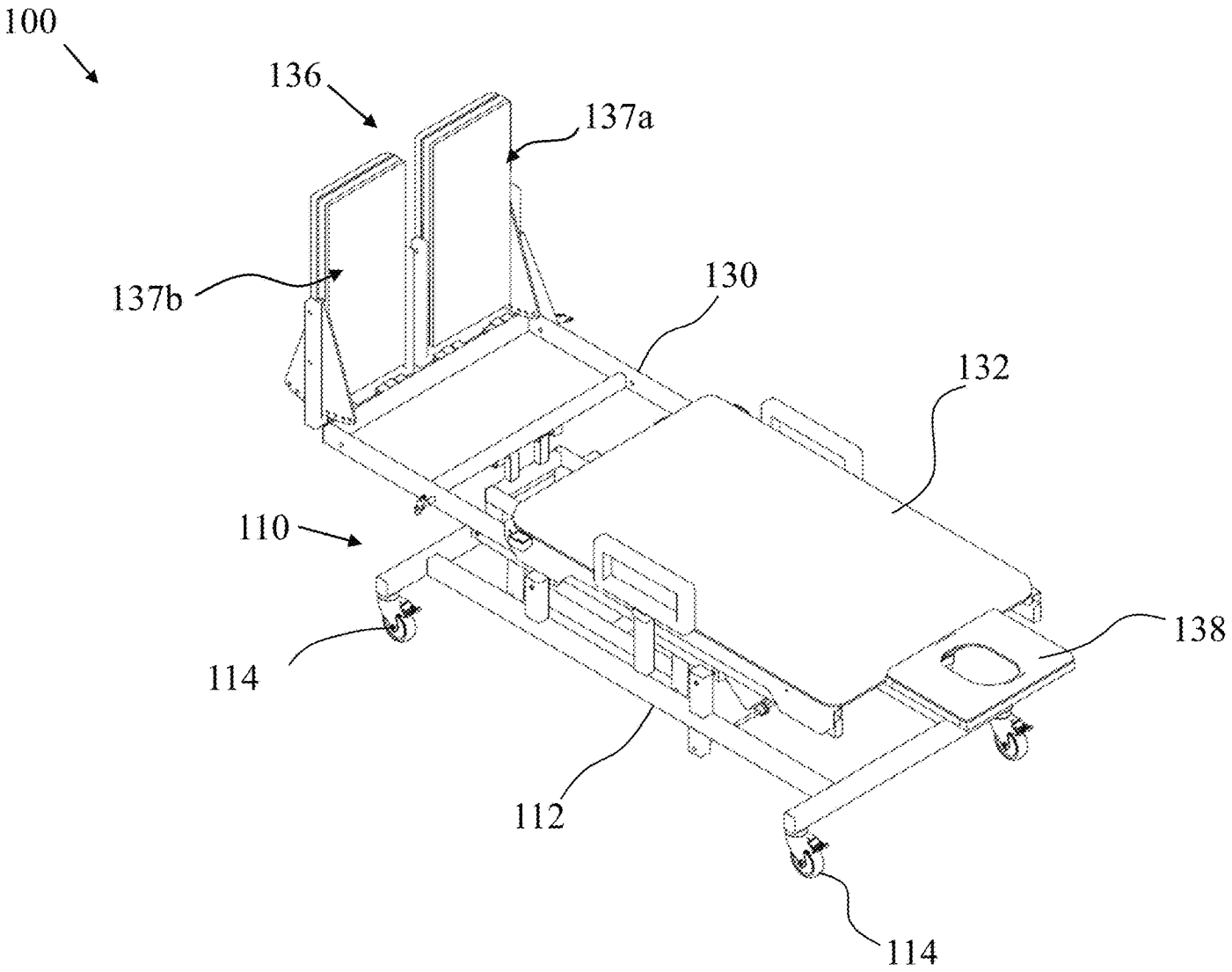
FIG. 4B is a right-side perspective view of the combined treatment and exercise apparatus illustrated in FIG. 1, having the foot rest members in a second state.
Figure 4C:
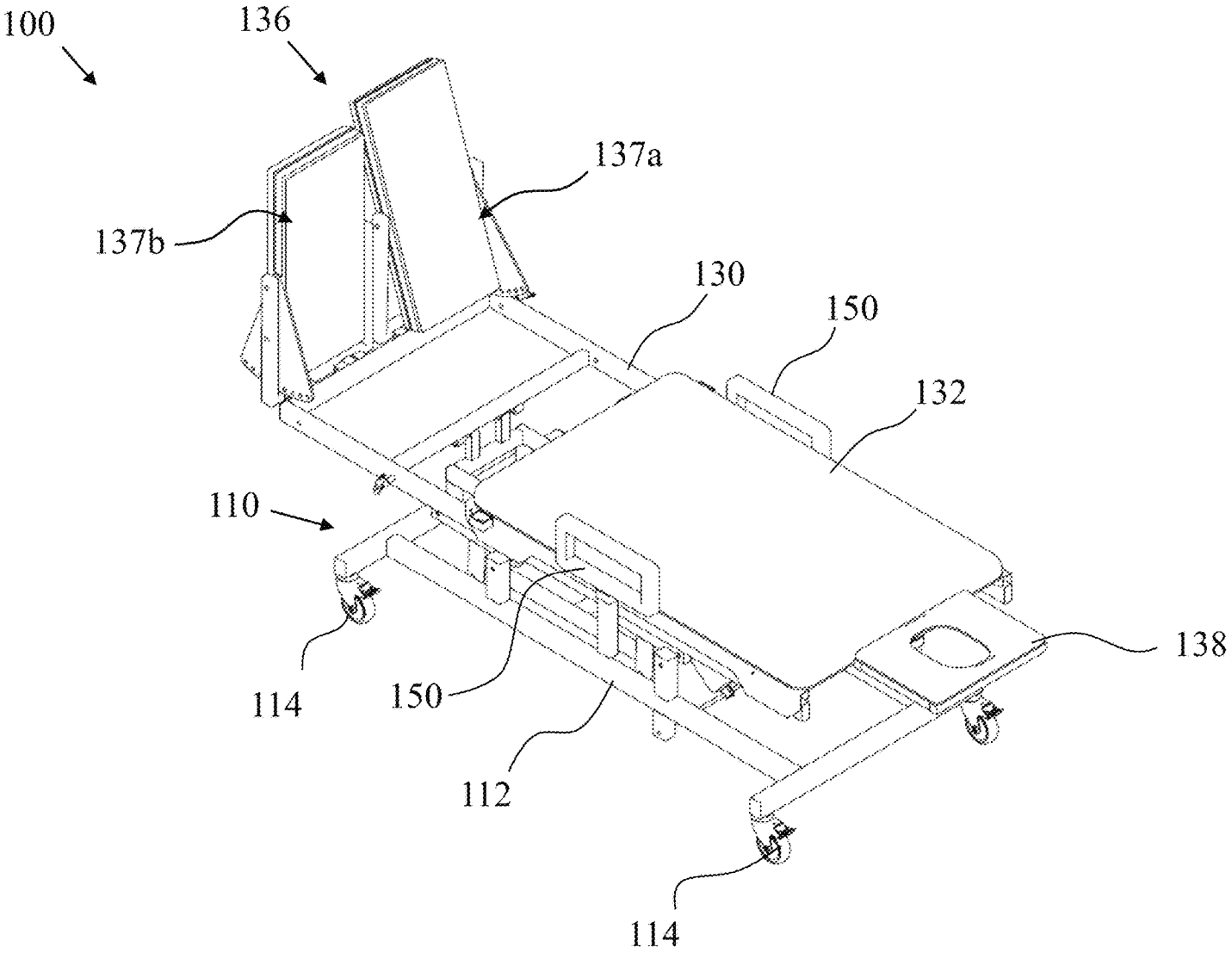
FIG. 4C is a right-side perspective view of the combined treatment and exercise apparatus illustrated in FIG. 1, having the a foot rest member in an inclined position.

FIG. 4A is a right-side perspective view of the combined treatment and exercise apparatus illustrated in FIG. 1, having the foot rest members in a first state, FIG. 4B is a right-side perspective view of the combined treatment and exercise apparatus illustrated in FIG. 1, having the foot rest members in a second state, and FIG. 4C is a right-side perspective view of the combined treatment and exercise apparatus illustrated in FIG. 1, having the a foot rest member in an inclined position;

Referring to FIGS. 4A through 4C, in the present embodiment, the combined treatment and exercise apparatus 100 further includes foot rest members 136 including a first foot rest member 137*a* and a second foot rest member 137*b* pivotably coupled to the second end 130*b* of the support frame 130.

The foot rest members 136 include a first side 136*a* and an opposing second side 136*b* and each foot rest member 136 pivots independently from the other foot rest member 136.

In an exemplary embodiment, the first foot rest member 137*a* and the second foot rest member 137*b* are each about 30 inches in length and pivots about 100 degrees. As such, the foot rest members 136 enables the combined treatment and exercise apparatus 100 to be used as a progressive resistant squat and multifunction device.

In further exemplary embodiments, the first foot rest member 137*a* and the second foot rest member 137*b* are each selectably lockable at varying degrees, as required. That is, the first and second foot rest members 137*a*, 137*b* may be inclined from about 0 degrees to about 180 in order to provide a platform for the patient to perform exercises, including squats. In alternative embodiments, the combined treatment and exercise apparatus 100 may allow for stretching of a user's ankles by allowing pivoting of at least 25 degrees.

In further exemplary embodiments, the first and second foot rest members 137*a*, 137*b* may lock in place when inclined to about 90 degrees with a plane of the treatment table 134. However, the present general inventive concept is not limited thereto.

In exemplary embodiments, the combined treatment and exercise apparatus 100 may further include a removable head rest member 138 configured to support a user's head during treatment, traction and exercise.

Figure 5A:
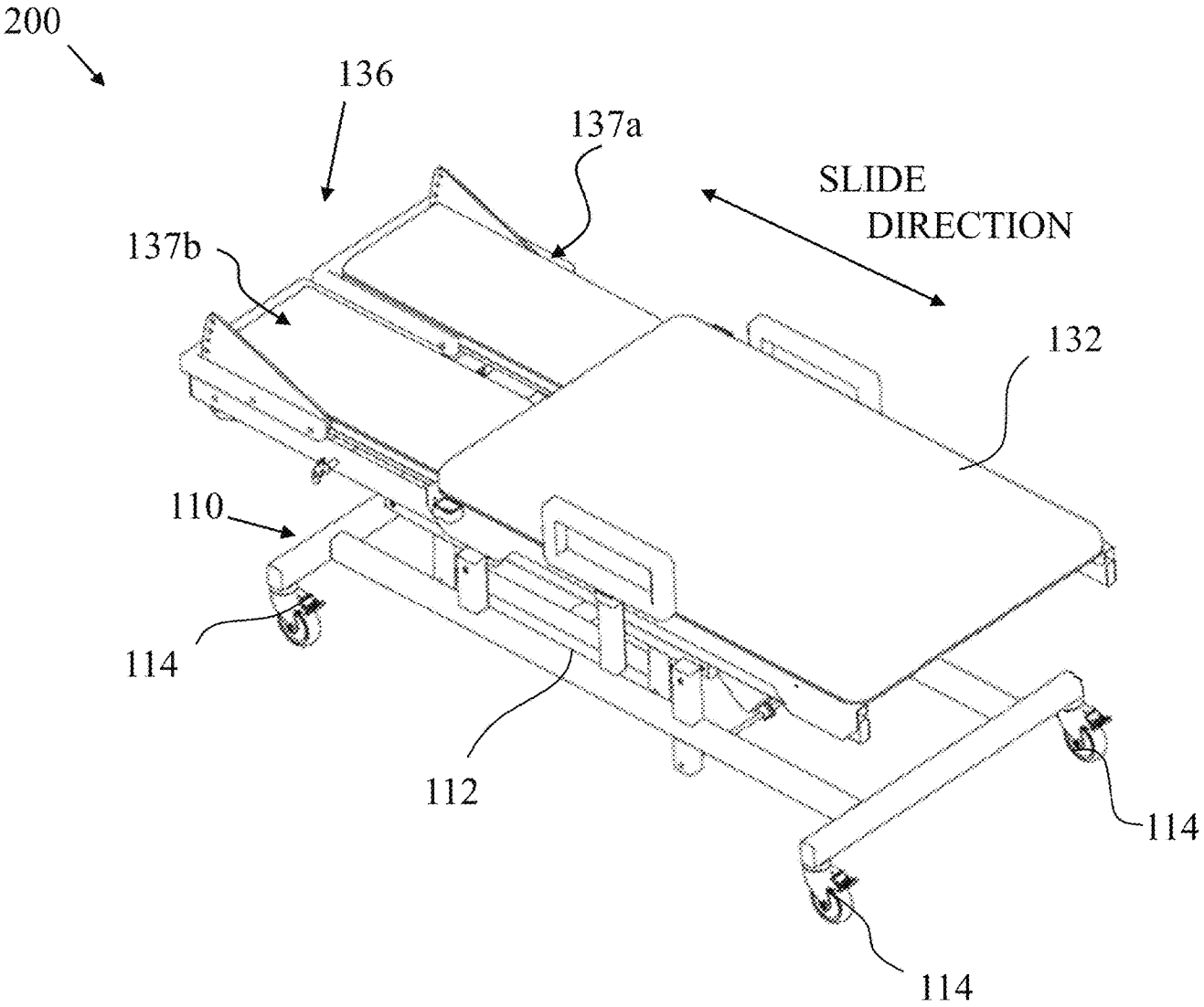
FIG. 5A is a left-side perspective view of a combined treatment and exercise apparatus according to another embodiment of the present general inventive concept, wherein the treatment table is in a first position.
Figure 5B:
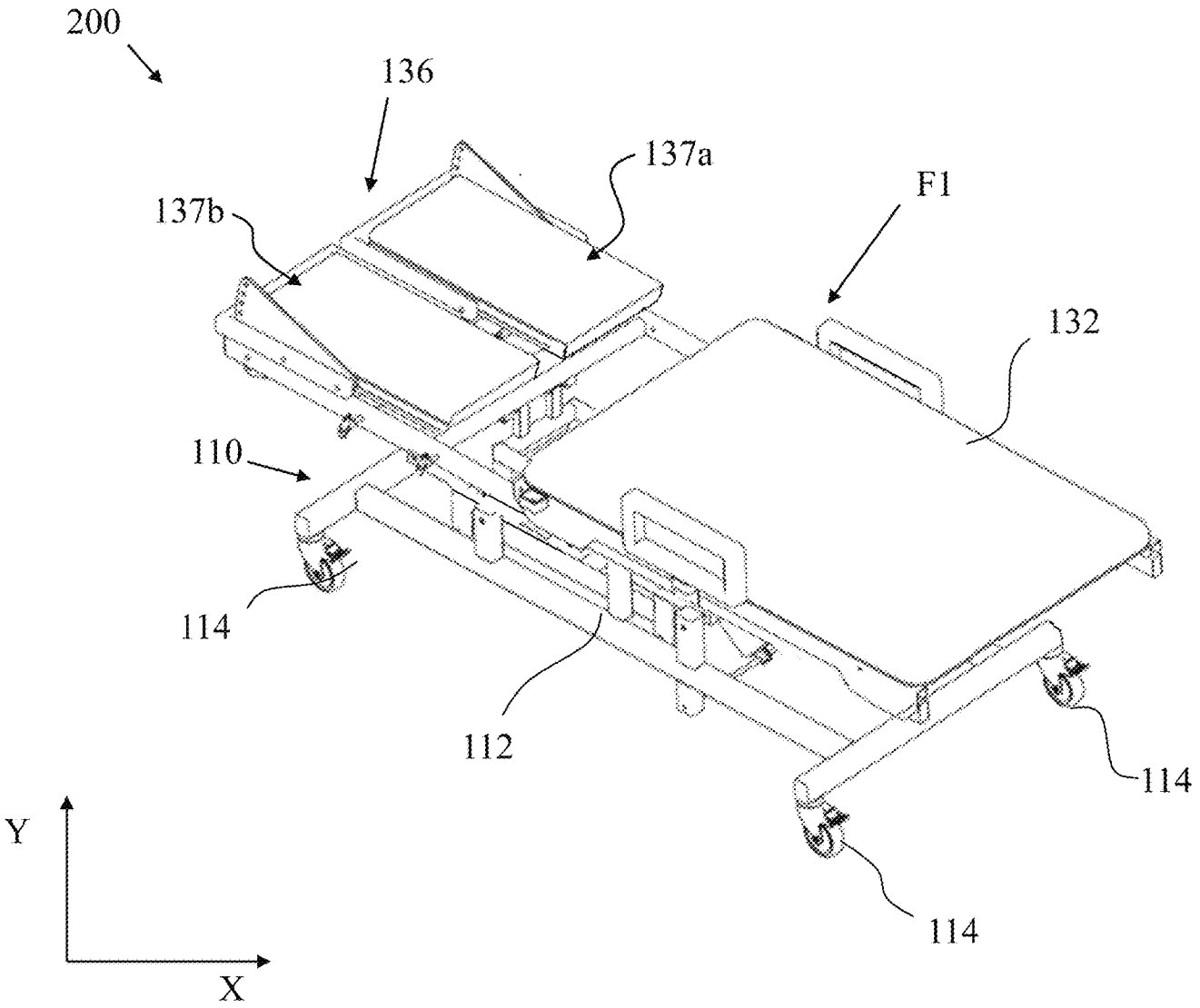
FIG. 5B is a left-side perspective view of a combined treatment and exercise apparatus illustrated in FIG. 5A, wherein the treatment table is in a second position.

FIG. 5A is a left-side perspective view of a combined treatment and exercise apparatus 200 according to another embodiment of the present general inventive concept, with a wherein the treatment table is in a first position. FIG. 5B is a left-side perspective view of a combined treatment and exercise apparatus 200 illustrated in FIG. 5A, wherein the treatment table is in a second position.

Referring to FIGS. 5A and 5B, the treatment table 132 of the combined treatment and exercise apparatus 100 may be manually moved between a first positon and a different second positon by a health care professional or the user. That is, the treatment table 132 may be moved along the direction indicated from the first position to the second position.

Figure 5C:
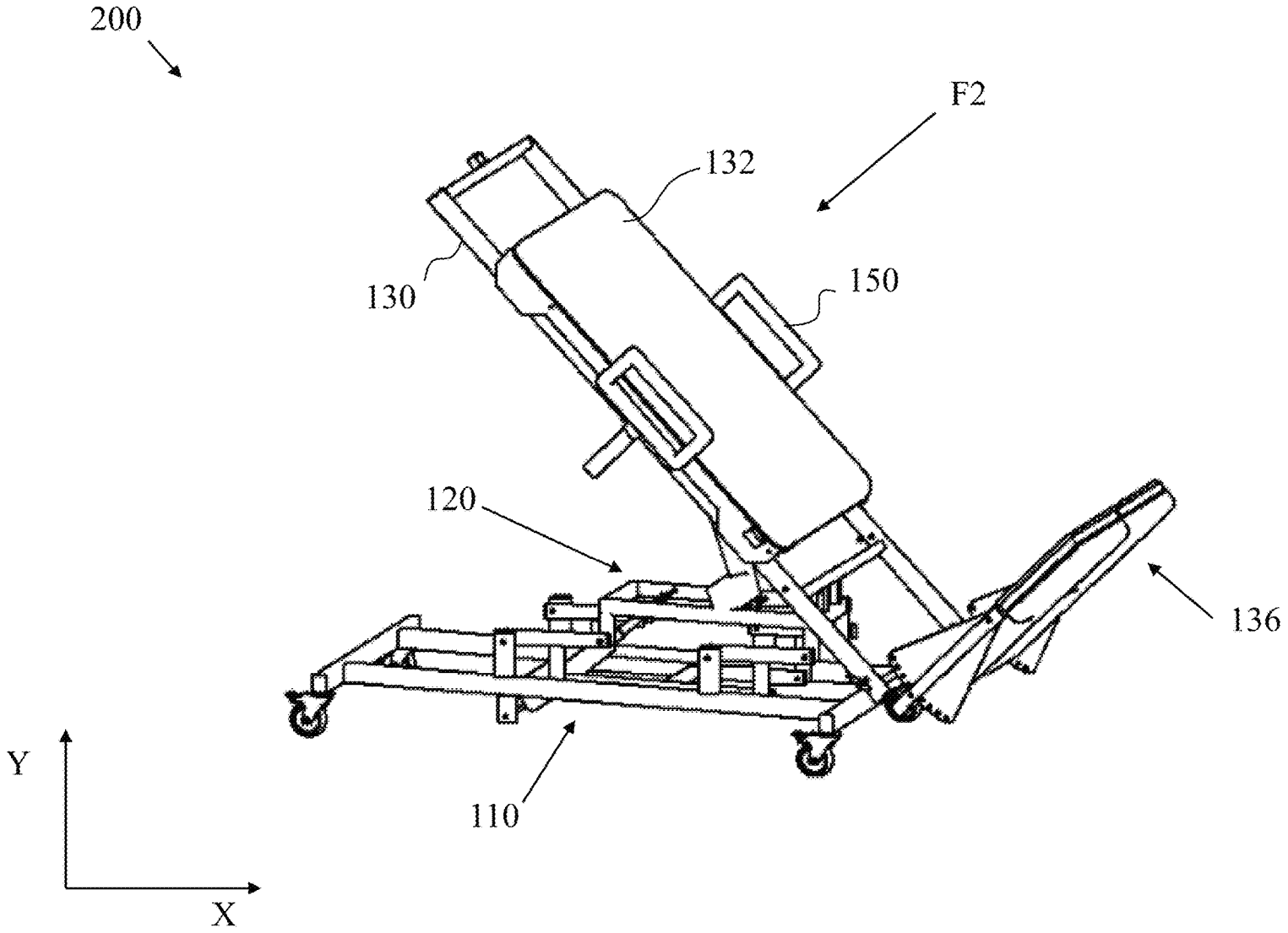
FIG. 5C is a left-side perspective view of the combined treatment and exercise apparatus illustrated in FIG. 5A, having a treatment table in an inclined position.
Figure 5D:
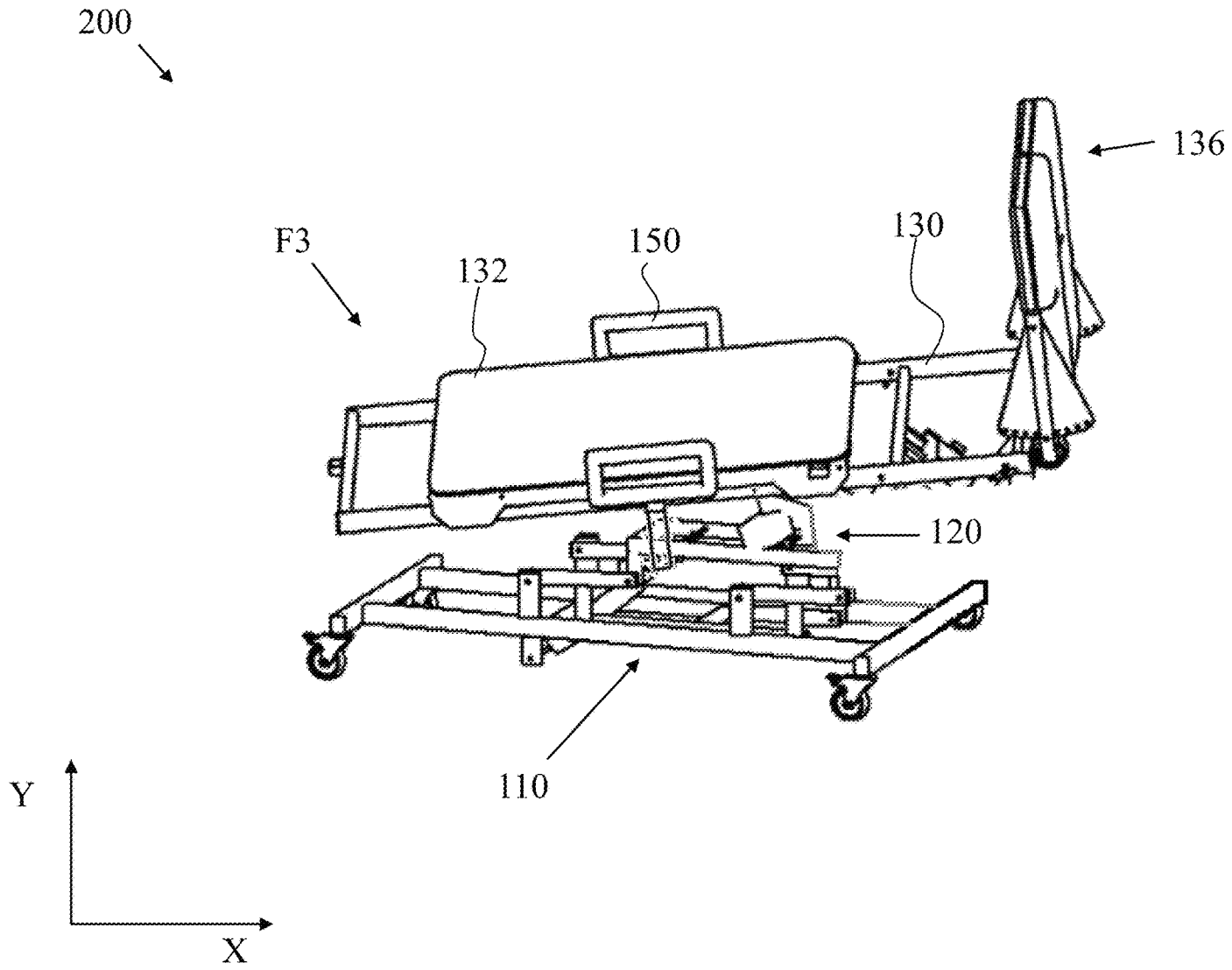
FIG. 5D is a left-side perspective view of the combined treatment and exercise apparatus illustrated in FIG. 5A, having a treatment table in a declined position.

FIG. 5C is a left-side perspective view of the combined treatment and exercise apparatus 200 illustrated in FIG. 5A, having a treatment table 132 in an inclined position and FIG. 5D is a left-side perspective view of the combined treatment and exercise apparatus 200 illustrated in FIG. 5A, having a treatment table 132 in a declined position.

Referring to FIGS. 5C and 5D, in the present embodiment, the support frame 130 is pivotally coupled to the plurality of linkages 120 which are formed and/or designed to pivot the support frame 130 between a first orientation F1 (e.g., a horizontal position), a second different orientation F2 (e.g., an inclined position), and a third different orientation F3 (e.g., a declined position) when one or more actuators of the plurality of actuators 140*a*, 140*b* is activated.

In an exemplary embodiment, the angle between the third orientation F3 and the second orientation F2 is about −10 degrees to about 90 degrees. As such, in response to one or more of the actuators 140 being activated, the treatment table 132 has a variable inclination from about negative 10 degrees from a horizontal plane H1 of the support frame 130 to about positive 90 degrees from the horizontal plane H1 of the support frame 130. As a result, the variable inclination of the treatment table 132 allows the user's body weight disposed thereon to be used as resistance for various types of exercises. However, the present general inventive concept is not limited thereto.

In the present embodiment, the combined treatment and exercise apparatus 200 includes a traction unit coupled to the second end 130*b* of the support frame 130 formed to apply traction to a user.

In the present embodiment, the treatment table 132 has a width of between about 30 inches and about 70 inches and a length of between about 48 inches and about 100 inches. However, the present general inventive concept is not limited thereto.

In exemplary embodiments, the combined treatment and exercise apparatus 200 further includes a locking member to selectably lock the treatment table 132 in various positions between the first position and the second position.

In further exemplary embodiments, the combined treatment and exercise apparatus 200 further includes one or more removable hand rails 150 disposed on opposite sides of the treatment table 132 to provide support for a user. The removable hand rails 150 are formed with a width of about 6 inches to about 36 inches. However, the present general inventive concept is not limited thereto.

In exemplary embodiments, the combined treatment and exercise apparatus 200 further includes a plurality of lockable wheels 114 coupled to the base. The plurality of lockable wheels 114 may be used to lock each wheel 114 in position for the safety of the patient.

In exemplary embodiments, the combined treatment and exercise apparatus 200 a lift mechanism formed to lift the treatment table 132 from a first height to a second different height with respect to the base. However, the present general inventive concept is not limited thereto.

That is, in alternative embodiments, the combined treatment and exercise apparatus 100 may include separate and distinct lift mechanisms for elevation, positive and negative tilt. As such, a patient may be able to transfer easily on and off the treatment table 132 while the sliding mechanism is locked.

In exemplary embodiments, the combined treatment and exercise apparatus 200 may further include a locking mechanism designed to lock the treatment table 132 in any elevated and/or inclined position.

In exemplary embodiments, the combined treatment and exercise apparatus 200, further includes a digital scale integrally formed between the treatment table 132 and the support frame 130 and configured to provide a load measurement.

In an exemplary embodiment, the combined treatment and exercise apparatus 200 allows a user to perform lower extremity closed chain exercises. For instance, a user may perform squats when the treatment table 132 is inclined from about 1 degree to about 90 degrees and the foot rest members 136 are inclined from about 1 degree to about 90 degrees with respect to a horizontal plane H1 of the support frame 130. As such, the combined treatment and exercise apparatus 100 allows the user to perform squats using from about 1 percent to about 90 percent of the users own weight. The integrated scales of the combined treatment and exercise apparatus 200 allows a health care professional to continuously monitor a weight bearing status of the user in real-time, during exercises critical when users have weight-bearing restrictions due to fractions or injury. In an embodiment, the scales may be integrated with the foot rest members 136. However, the present general inventive concept is not limited thereto.

Figure 6A:
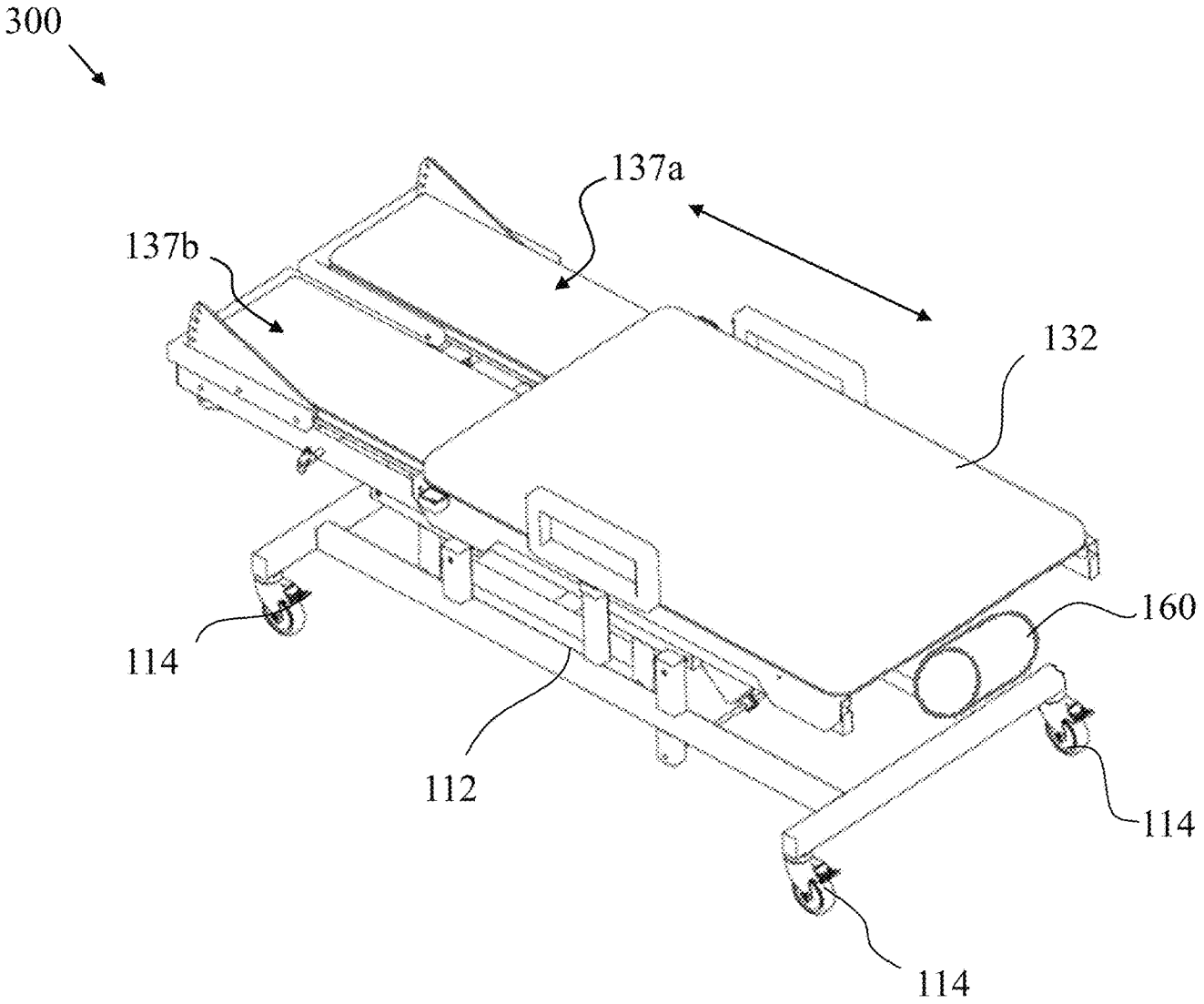
FIG. 6A is a left-side perspective view of a combined treatment and exercise apparatus according to another embodiment of the present general inventive concept, having a treatment table in a first position and a traction motor.
Figure 6B:
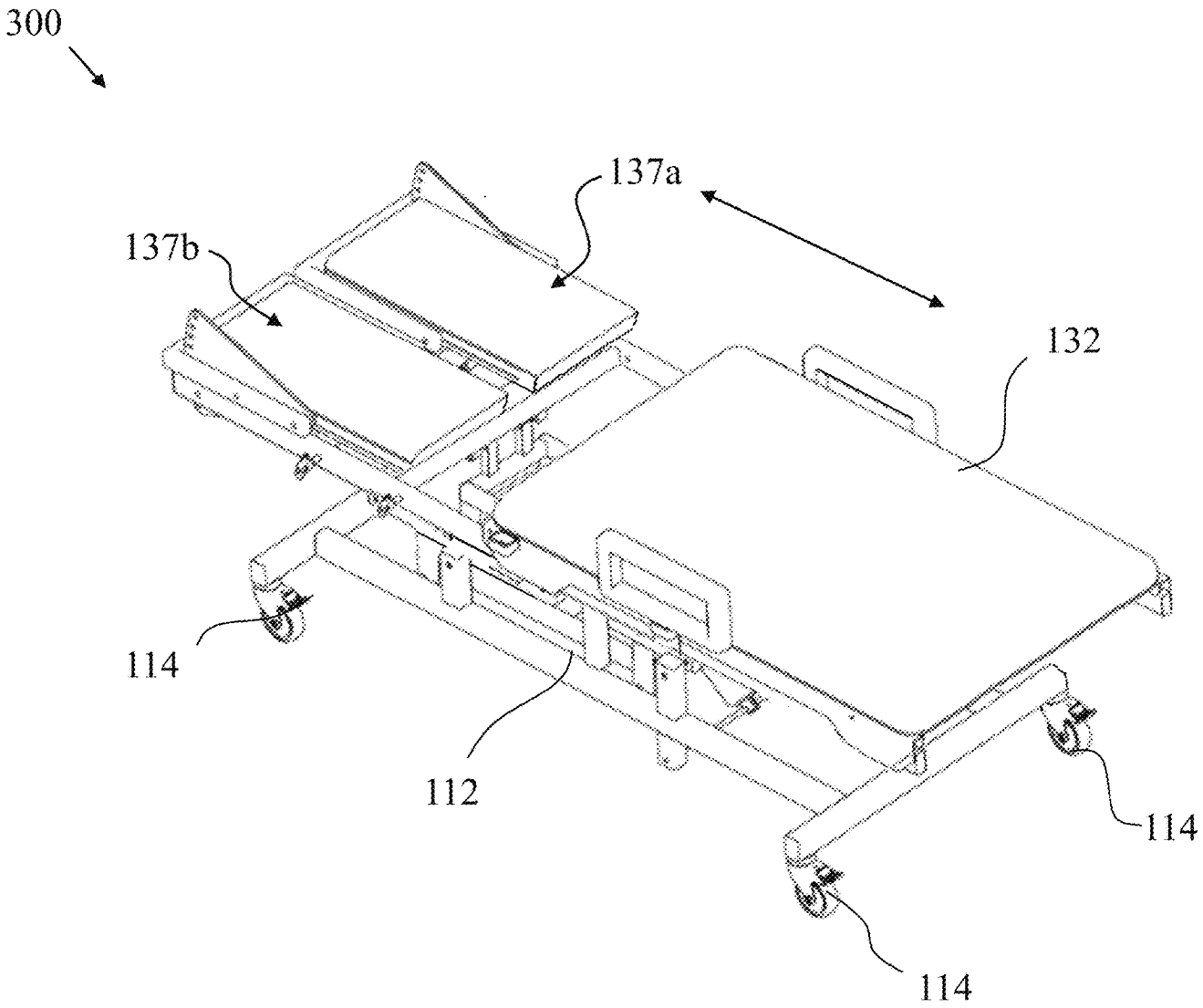
FIG. 6B is a left-side perspective view of the combined treatment and exercise apparatus illustrated in FIG. 6A, having a treatment table in a second position.

FIG. 6A is a left-side perspective view of a combined treatment and exercise apparatus 300 according to another embodiment of the present general inventive concept, having a treatment table 132 in a first position and a traction motor. FIG. 6B is a left-side perspective view of the combined treatment and exercise apparatus 300 illustrated in FIG. 6A, having a treatment table 132 in a second position.

Referring to FIGS. 6A and 6B, the treatment table 132 of the combined treatment and exercise apparatus 300 may be mechanically moved between a first positon and a different second positon by a traction motor 160.

Figure 7:
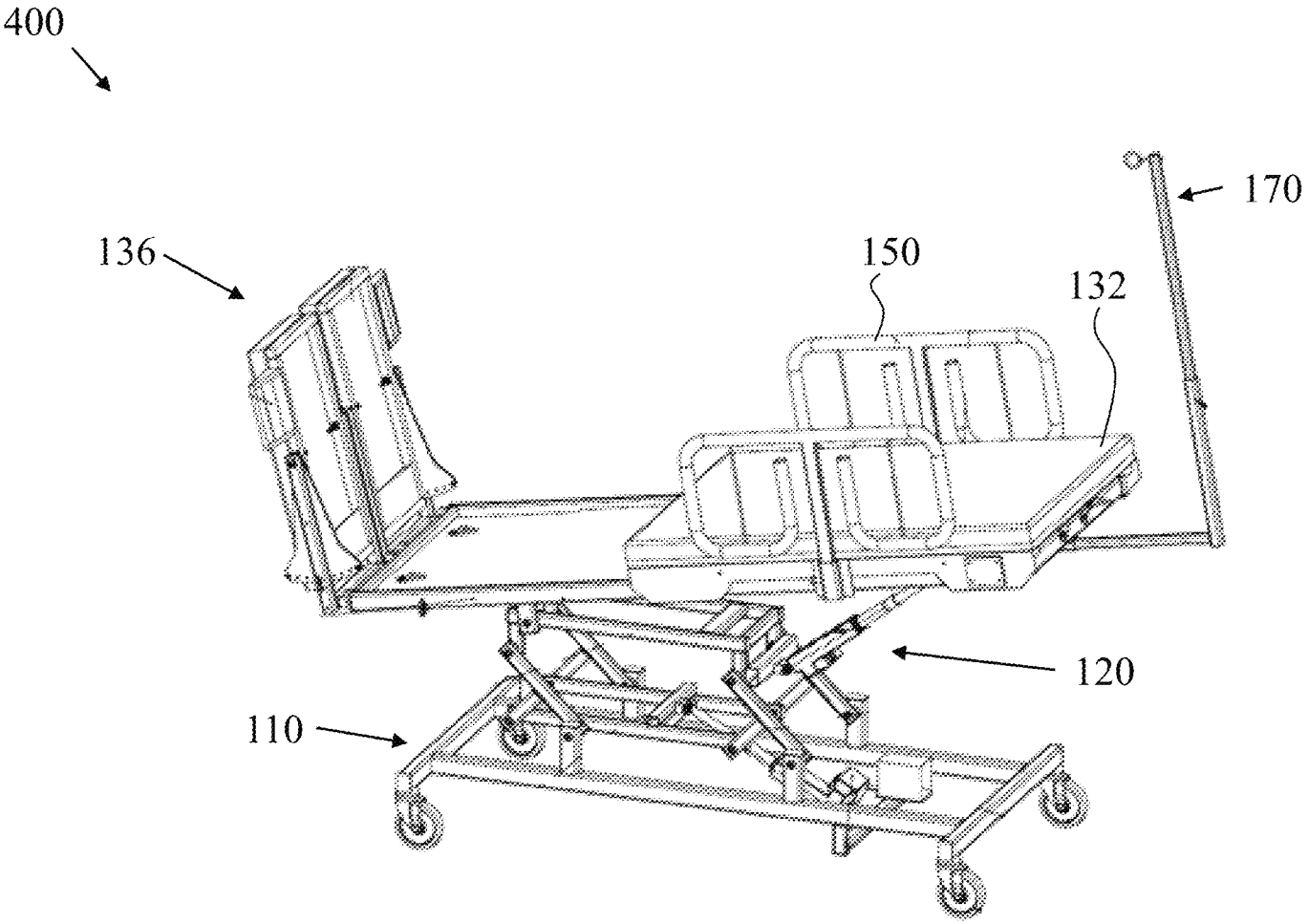
FIG. 7 is a left-side perspective view of a combined treatment and exercise apparatus according to another embodiment of the present general inventive concept, having a pulley.

FIG. 7 is a left-side perspective view of a combined treatment and exercise apparatus 400 according to another embodiment of the present general inventive concept, having a pulley system 170.

Referring to FIG. 7, in the present exemplary embodiment, the combined treatment and exercise apparatus 400 may be used to perform traction on a user in one or more methods. In particular, the combined treatment and exercise apparatus 400 may be used for self-traction which allows the user to perform self-traction when the treatment table 132 is inclined using the one or more actuators 140. As a result, gravity and the users applied force through the pulley system 170 helps provide traction on the user. That is, the user can apply his or her own traction force by using a pulley system 170 attached to his or her body.

Next, the combined treatment and exercise apparatus 400 may be used for manual traction which allows a health-care professional to apply a traction force on the user disposed on the treatment table 132. The treatment table 132 may further be inclined about 90 degrees and/or declined at least 10 degrees to assist with manual traction of the user.

Further, the combined treatment and exercise apparatus 400 may be used for mechanical traction which includes a traction motor 160 placed at an end of the support frame 130 which can be activated to provide a traction force on the user disposed on the treatment table 130. As such, when a user is strapped to the treatment table 132, the motor 160 may be used to apply traction force at a predefined amount of force to provide consistency of treatment.

The combined treatment and exercise apparatus according to the present general inventive concept is designed and configured as a portable therapy apparatus that combines a treatment table, an exercise device, and a traction table into a single, light-weight and portable device. That is, the combined treatment and exercise apparatus is designed as a portable combined treatment, exercise, and traction device designed to easily transition a patient (i.e., a user) from the treatment table to an exercise apparatus capable of being used to perform lower extremity exercises on the patient, without the patient needing to get off the treatment table.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. A combined treatment, exercise, and traction apparatus, the apparatus comprising:

a base;

a support frame operatively supported by the base and having a first end and an opposing second end;

a treatment table having a first end and an opposing second end, the treatment table mounted to the support frame; and a first foot rest member frame and a second foot rest member frame, wherein the first foot rest member frame includes a first foot rest member, and wherein the second foot rest member frame includes a second foot rest member, wherein each foot rest member frame is pivotally coupled to the second end of the support frame, wherein each of the first and second foot rest member frames are independently pivotable relative to the support frame between a first foot rest member frame position generally parallel to the support frame and a second foot rest member frame position generally perpendicular to the support frame, and wherein each of the first and second foot rest member frames includes a respective pivot plate, wherein each pivot plate is fixed relative to the respective first or second foot rest member, wherein each pivot plate includes a plurality of holes, wherein each hole corresponds to a respective one of the plurality of pivot positions, wherein each of the first foot rest member and the second foot rest member includes a resilient button disposed in facing relation with the respective pivot plate and is configured to be aligned with the plurality of pivot plate holes, and wherein the plurality of pivot plate holes, and wherein the plurality of pivot plate holes and the resilient button enable each of the foot rest members to be selectably lockable at varying pivot positions.

2. The apparatus of claim 1, wherein the first foot rest member is pivotable relative to the first foot rest member frame about a center axis of the first foot rest member, and wherein the second foot rest member is pivotable relative to the second foot rest member frame about a center axis of the second foot rest member.

3. The apparatus of claim 2, wherein the center axis of each foot rest member extends transversely across the respective foot rest member.

4. The apparatus of claim 3, wherein each of the first and the second foot rest members is configured to pivot about the respective center axis between a plurality of pivot positions.

5. The apparatus of claim 4, wherein the resilient button is configured to extend in one of the plurality of pivot plate holes, wherein when the resilient button extends within one of the pivot plate holes the respective foot rest member is held fixed in the current pivot position.

6. The apparatus of claim 5, wherein the resilient button is configured to be depressed so it does not extend in one of the plurality of holes of the pivot plate, wherein when the resilient button is not extending within one of the pivot plate holes the respective foot rest member is enabled to be pivoted from the current pivot position.

7. The apparatus of claim 6, wherein each of the first and second foot rest members includes a scale for monitoring a weight of a user.

8. The apparatus according to claim 7, wherein each of the first and second foot rest members includes a first side and a second side, wherein when each of the first and second foot rest members frames are in the first foot rest member frame position the first side of the foot rest members extends generally parallel with the treatment table.

9. The apparatus according to claim 8, wherein when each of the first and second foot rest member frames are in the second foot rest member frame position, and the treatment table is in an inclined position, a user is enabled to support the user's weight at least in part on the second side of the foot rest members.

10. An apparatus configured to be detachably coupled to a treatment table, the apparatus comprising:

a first foot rest member frame, wherein the first foot rest member frame includes a first foot rest member; and a second foot rest member frame, wherein the second foot rest member frame includes a second foot rest member;

wherein each foot rest member frame is configured to be detachably and pivotally coupled to the treatment table, wherein each of the first foot rest member frame and the second foot rest member frame are independently pivotable between a first foot rest member frame position generally parallel to a horizontal plane of the treatment table and a second foot rest member frame position generally perpendicular to the horizontal plane of the treatment table, wherein each of the first and the second foot rest member frames includes a respective pivot plate, wherein each pivot plate is fixed relative to the respective first or second foot rest member, wherein each pivot plate includes a plurality of holes, wherein each pivot plate hole corresponds to a respective one of the plurality of pivot positions, wherein each of the first foot rest member and the second foot rest member includes a resilient button disposed in facing relation with the respective pivot plate and is configured to be aligned with the plurality of pivot plate holes, and wherein the plurality of pivot plate holes and the resilient button are engageable such that the foot rest members are enabled to be selectably lockable at varying pivot positions.

11. The apparatus of claim 10, wherein the first foot rest member is pivotable relative to the first foot rest member frame about a center axis of the first foot rest member, and wherein the second foot rest member is pivotable relative to the second foot rest member frame about a center axis of the second foot rest member.

12. The apparatus of claim 11, wherein each of the first and the second foot rest members is configured to pivot about the respective center axis between a plurality of pivot positions.

13. The apparatus of claim 12, wherein the resilient button is configured to extend in one of the plurality of pivot plate holes, wherein when the resilient button extends within one of the pivot plate holes the respective foot rest member is held fixed in the current pivot position.

14. The apparatus of claim 13, wherein the resilient button is configured to be depressed to a position where it does not extend in one of the plurality of pivot plate holes, wherein when the resilient button is not extending within one of the pivot plate holes the respective foot rest member is enabled to be pivoted from the current pivot position.

15. The apparatus of claim 14, wherein each of the first and second foot rest members includes a scale for monitoring a weight of a user.

16. The apparatus according to claim 15, wherein each of the first and second foot rest members includes a first side and a second side, wherein when each of the first and second foot rest members frames are in the first foot rest member frame position the first side of the foot rest members extends generally parallel with the treatment table.

17. The apparatus according to claim 16, wherein when each of the first and second foot rest member frames are in the second foot rest member frame position, and the treatment table is in an inclined position, a user is enabled to support the user's weight at least in part on the second side of the foot rest members.

18. A combined treatment, exercise, and traction apparatus, the apparatus comprising:

a base coupled to a plurality of linkages;

a support frame having a first end and opposing second end pivotally coupled to the plurality of linkages, the support frame formed to pivot between a first orientation and a different second orientation;

a treatment table having a first end and an opposing second end, the treatment table slidably mounted to the support frame;

a first foot rest member and a second foot rest member pivotally coupled to the second end of the support frame, wherein the first and second foot rest members are individually pivotable between a first foot rest position generally parallel to the support frame and a second foot rest position generally perpendicular to the support frame; and a plurality of actuators coupled between the base and the plurality of linkages, wherein the treatment table slides between a first position and a second position along a plane of the support frame when a first actuator is activated.

* * * * *